United States Patent [19]

MacDonald

[11] 4,045,299

[45] Aug. 30, 1977

[54] SMOKELESS NON-RECOVERY TYPE COKE OVEN

[75] Inventor: James E. MacDonald, Latrobe, Pa.

[73] Assignee: Pennsylvania Coke Technology, Inc., Greensburg, Pa.

[21] Appl. No.: 634,602

[22] Filed: Nov. 24, 1975

[51] Int. Cl.[2] ..... C10B 9/00

[52] U.S. Cl. ..... 202/93; 23/277 C; 201/15; 201/27; 202/102; 202/211

[58] Field of Search ..... 202/92, 93, 101, 102, 202/113, 114, 211, 212; 201/13, 14, 15, 27; 110/8 A; 23/277 C

[56] References Cited

U.S. PATENT DOCUMENTS

| | | | |
|---|---|---|---|
| 500,684 | 7/1893 | Westermann | 202/101 |
| 537,872 | 4/1895 | Vannier | 202/211 |
| 773,809 | 11/1904 | Ramsay | 202/211 X |
| 1,269,895 | 6/1918 | Zwillinger | 202/101 |
| 3,215,501 | 11/1965 | Phillips | 110/8 A X |
| 3,462,346 | 8/1969 | Kernan | 201/27 X |
| 3,763,012 | 10/1973 | Kelley | 202/212 X |
| 3,912,597 | 10/1975 | MacDonald et al. | 201/15 X |

*Primary Examiner*—Joseph Scovronek
*Assistant Examiner*—Arnold Turk
*Attorney, Agent, or Firm*—Brown, Murray, Flick & Peckham

[57] ABSTRACT

A burner for oil or gas is controlled by a thermocouple to maintain a predetermined minimum operating temperature within ignition chambers employed to incinerate partially-burned distillation products conducted from the space above a coal charge in a coke oven. Passageways in the side walls of the coke oven conduct the partially-burned distillation products from the space above the coal charge into sole heating flues located below the oven floor from where such distillation products are conducted into the ignition chambers. A stack is connected to the ignition chambers by a conduit which includes a recuperator used to reduce the temperature of the burned gases and provides a heated secondary air supply. This air supply is fed by separate pipes including control valves into one of the ignition chambers and into the passageways in the side walls of the coke oven. The stack includes a gas washer and a fan used to control the draw on the ignition chambers as well as the coke oven.

9 Claims, 2 Drawing Figures

SMOKELESS NON-RECOVERY TYPE COKE OVEN

BACKGROUND OF THE INVENTION

Figure 1:
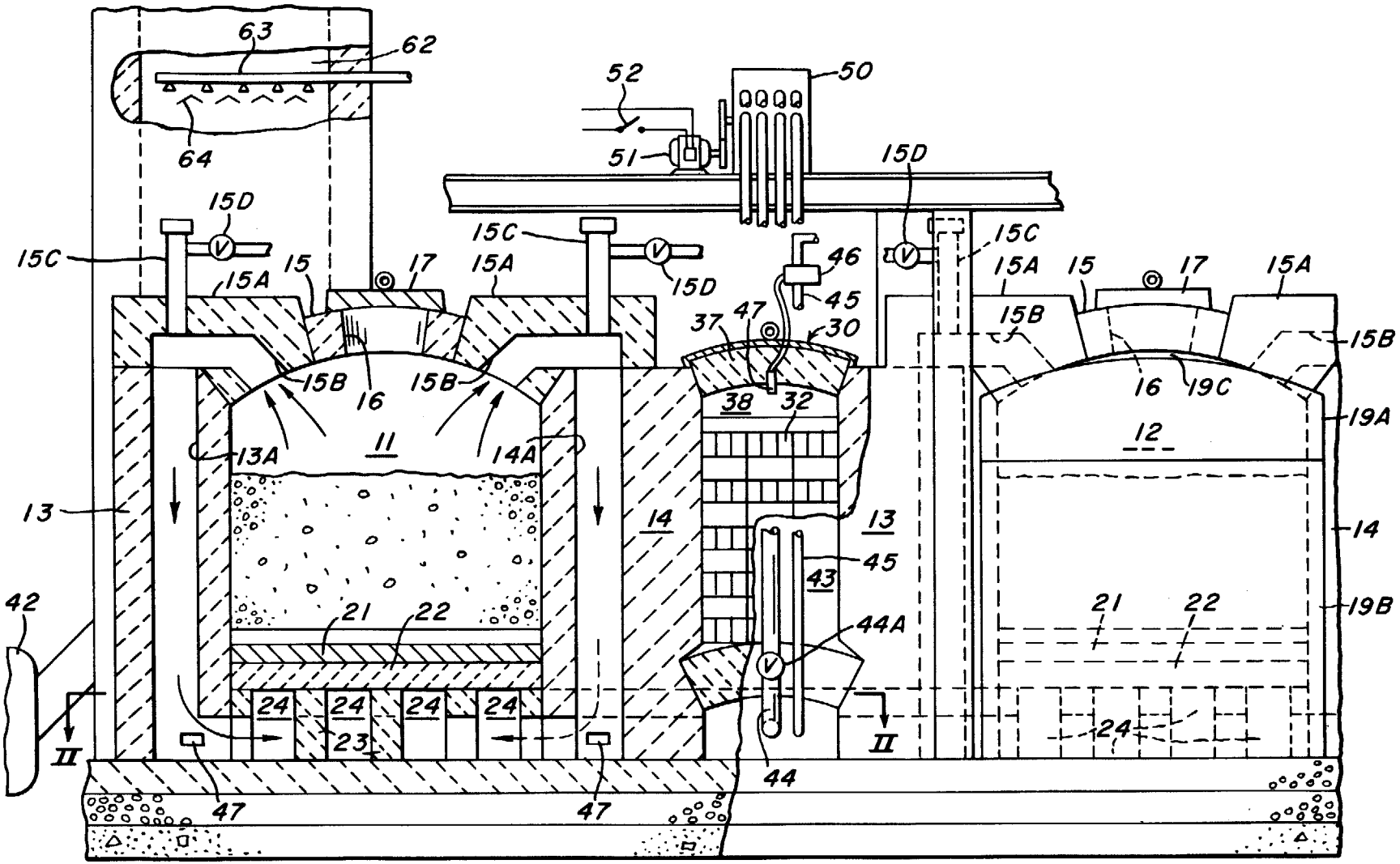

This invention relates to the production of coke in a non-recovery type coke oven, and more particularly to apparatus for maintaining a desired operating temperature within ignition chambers employed to incinerate the distillation products liberated during the coking process for the smokeless operation of the coke oven.

As is known, there are two major methods for the manufacture of metallurgical coke. The earliest of these methods is a non-recovery type process wherein air is admitted into the coking chamber in controlled amounts for the purpose of burning the volatile products liberated from the coal charge without consuming the coal during the destructive distillation process. In this way, the heat generated by burning the volatile products is used to continue the distillation process. The smoke and other unburned volatile products liberated during the coking process were discharged into the atmosphere in the past. Because these emissions are a source of environmental pollution, the non-recovery type coking process has been largely done away with.

A more recent method for producing coke is known as a by-product or a retort process wherein air is excluded from a coking chamber during the distillation process and all volatile products liberated during the process are recovered as gas and other coal by-product chemicals. It is, therefore, possible to carry out a retort process in an essentially smokeless manner. Part of the distillation gases recovered as by-products are burned to provide the necessary heat to continue the coking process and the remaining portion of the distillation gases is processed to recover heretofore valuable coal chemicals. In recent years, coke producers using the by-product process have had difficulty disposing of the recovered coal chemicals on a profitable basis, particularly since many of the same or equivalent chemicals are recovered incident to the refining of petroleum products. The cost of producing coke by the by-product method can no longer be offset by the sale of by-product chemicals.

The non-recovery type coke oven is sometimes referred to as a beehive coke oven. Such coke ovens were built adjacent each other to form a coke oven battery. Coke was pulled from alternative ovens on alternate days so that the heat from the side walls of a hot coke oven would ignite the coal in a newly-charged and adjacent oven. The cycle for the production of coke by each oven chamber was about 72 hours. The non-recovery type coking process has again become an important factor to the coking industry, particularly in light of the more favorable economics of the process. A non-recovery type coking process is less costly and coke ovens used to carry out the process can be economically built at remote coal mine locations from where the coke can be shipped at less cost to facilitate using coke such as blast furnaces.

In my prior U.S. Pat. No. 3,912,597, there is disclosed a smokeless non-recovery type coke oven wherein the distillation gases liberated during a coking process are conducted from the space above a coal charge downwardly along passageways in the side walls forming the oven chamber into a sole heating flue from where the gases are fed by a passageway into a tandem arrangement of ignition chambers. These ignition chambers are employed to carry out complete combustion of the partially-burned distillation products. A stack discharges the burned gases from the ignition chambers into the atmosphere. During the actual operation of such a coke oven, it is necessary to periodically perform needed repairs to the oven brickwork. Therefore, one or more coke ovens must be taken out of operation and permitted to cool down to an ambient temperature. After maintenance and repairs to the brickwork have been completed, an unusually and unacceptable long period of time is required to generate sufficient quantities of heat when operating on the natural draft produced by the stack so that the coking process can be carried out at the desired temperature. Moreover, a charge of off-grade coal may occasionally and unknowingly be charged into the oven chambers. This causes the temperature to drop within the oven chamber and the ignition chambers with an attending acute problem of undesirable and even unacceptable emissions from the stack. Such emissions will continue until a sufficient quantity of heat is restored in the coke oven and ignition chambers to carry out the coking process at the desired elevated temperature. When this form of non-recovery type coking chamber is activated from an ambient temperature, a booster fan in the stack is used to provide the necessary additional draft to overcome a resistance to the flow of gases created by the checkerbricks in the ignition chambers. The coking chamber is operated on an increased draft until the temperature of the oven has risen sufficiently and then the coking process will proceed on natural draft alone.

I have also discovered that when a coking chamber is at an operating temperature of about 2500° F, there develops a back-pressure to the natural draft which causes poor and inefficient secondary combustion of the distillation products in the sole flues and passageways within the walls of the coke oven chamber. This secondary combustion does not incinerate the distillation products but does represent a partial combustion thereof. This, however, effects the efficiency of the coking process and causes a fluctuation to the temperature in the ignition chambers used to incinerate the gases. The temperature within the ignition chambers must be maintained at a minimum of, for example, 1400° F to incinerate all gases reaching this point and before the gases pass to the stack.

SUMMARY OF THE INVENTION

It is an object of the present invention to provide a smokeless non-recovery type coke oven wherein the distillation products liberated in a coking chamber pass into a sole heating flue and thence into an ignition chamber which is maintained at a predetermined minimum temperature to incinerate the distillation products so that the burned gases can be discharged by a stack into the atmosphere without causing pollution.

It is a further object of the present invention to provide a smokeless non-recovery type coke oven wherein the distillation product liberated in a coking chamber is mixed with secondary air fed into downcomers formed in the walls of the coking chamber and mixed with secondary air fed into an ignition chamber to control the combustion for incineration of the distillation product.

It is still another object of the present invention to provide a smokeless non-recovery type coke oven wherein the distillation product liberated in a coking chamber is incinerated in an ignition chamber from which the sensible heat of the burned gases is recovered by a recuperator before the gases flow into a stack to reduce the temperature of the gases and provide a source of heated secondary air for introduction into the ignition chamber and/or downcomers provided in the walls of the coking chamber to control the combustion therein of the distillation product.

According to the present invention there is provided a smokeless and non-recovery type coke oven comprising means for forming an oven chamber including side walls, an oven roof carried by the side walls, removable door means for the discharge of coke from the oven chamber, a floor to support a coal charge introduced into the oven chamber through a closable opening in the roof, means defining a sole heating flue for conducting partially-burned distillation products beneath the floor in heat-conducting contact therewith, means for conducting partially-burned distillation products from the space above a coal charge in the oven chamber into the sole heating flue, means defining a discharge flue arranged to receive the partially-burned distillation products from the sole heating flue, ignition chamber means including checkerbrick therein to incinerate the partially-burned distillation products conducted thereto from the space above the coal charge in the oven chamber, means to heat the ignition chamber means independently of the heat liberated by incinerating the partially-burned distillation products for maintaining a predetermined elevated operating temperature within the ignition chamber means, and a stack for drawing combustion products from the ignition chamber means.

It is preferred to employ heat recovery means such as a recuperator to reduce the temperature of the burned gases discharged from the aforementioned ignition chamber means to not only protect a gas scrubber unit in the stack but also provide a supply of heated secondary air which is controllably introduced into the ignition chamber means and/or into the means for conducting partially-burned distillation products from the space above the coal charge in the oven chamber into the sole heating flue. However, the supply of secondary air need not be heated whereby pipes with separate valves coupled directly to a blower are used to introduce the secondary air into the ignition chamber means and/or the means for conducting partially-burned distillation products into the sole heating flue.

Figure 2:
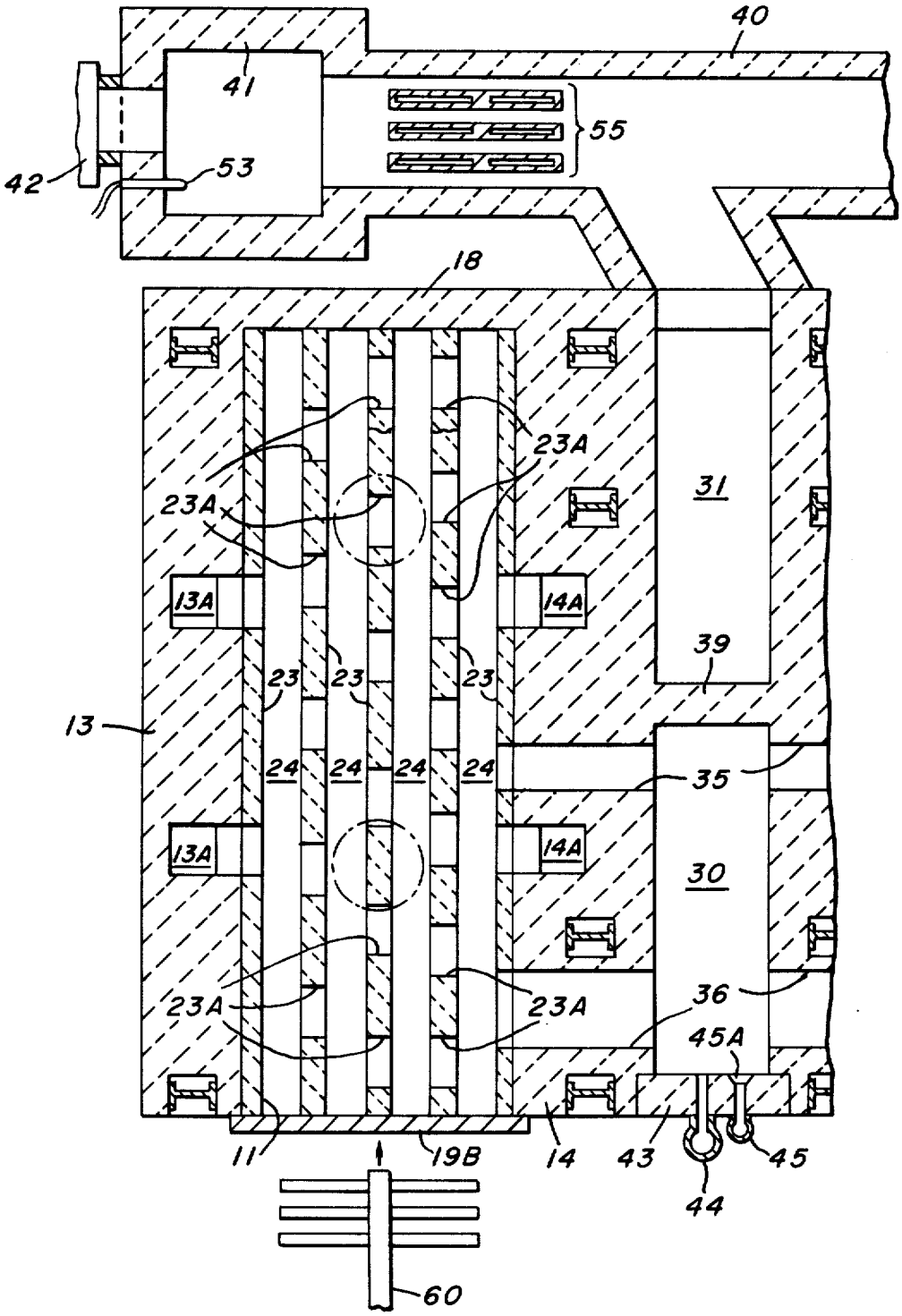

These features and advantages of the present invention as well as others will be more readily understood when the following description is read in light of the accompanying drawings, in which:

FIG. 1 is an elevational view, partly in section, of smokeless and non-recovery type coke ovens embodying the features of the present invention; and FIG. 2 is a plan view, in section, taken along line II—II of FIG. 1.

FIGS. 1 and 2 illustrate two adjacent coke oven chambers 11 and 12. The structure defining each coke oven chamber includes upstanding side walls 13 and 14 that are made of refractory brick or the like. An arched roof 15 is carried by the top surface of the side walls and spans the distance between them. One or more trunnel head openings 16 are formed in the oven roof depending upon the length of the oven chamber. Each of these openings is provided with a cast iron damper 17 which is removable to charge coal through the opening 16 into the oven chamber. A wall 18 closes one end of the oven chamber and upper and lower doors 19A and 19B, respectively, close the opposite end of the oven chamber. These doors are removable to extract coke at the end of a coking process. As shown in FIG. 1 in regard to coke oven chamber 12, the upper curve surface of door 19A forms a gap 19C used for the supply of primary air into the coking chamber. Clay or similar material is employed to vary the size of the gap 19C at various times throughout the coking process.

A charge of coal is supported in the oven chamber by a floor 21 that slopes in a downward direction from the wall 18 toward the doors to facilitate removel of the coke. The floor of the oven chamber is preferably made of silicon carbide or other refractory material of high heat conductivity. The floor 21 rests on a bed of silica tile 22 that is, in turn, supported by spaced-apart columns 23 that are arranged parallel to the side walls 13 and 14 to form flue spaces 24 between the columns. Flue spaces 24 are interconnected by a staggered arrangement of openings 23A in the columns. In this way, the flues 24 actually form sole flues that are used to extract residual heat from partially-burned distillation products that are drawn from the space above the coal charge in the coke oven chamber and flow through downcomers 13A and 14A. These downcomers are passageways formed in side walls 13 and 14, respectively. FIG. 2 illustrates two such downcomers in each of the side walls 13 and 14.

Part of the oven roof is made of sections 15A by using cast refractory material. Formed in these sections are passageways 15B that communicate between the space in the oven chamber above the coal charge and the top of the downcomers 13A and 14A. According to a feature of the present invention, each passageway 15B is additionally provided with an opening that extends through the top of the roof section 15A where it communicates in a sealed relation with a vertical pipe 15C. The pipes 15C are employed to introduce secondary air for mixing with the partially-burned distillation gases passing downwardly in the downcomers as will be more fully described hereinafter.

While the features and advantages of the present invention are useful for a single coke oven chamber, a battery of coke oven chambers may be arranged in a side-by-side relation and in this regard the two coking chambers 11 and 12 illustrated in the drawings are intended to represent a portion of such a battery of coke oven chambers. Lying between the coking chambers 11 and 12 are interconnected ignition chambers 30 and 31 that are arranged in an end-to-end relation between the side walls 14 of chamber 11 and the side walls 13 of chamber 12. The side walls 14 and 13 of the oven chambers 11 and 12, respectively, have an added thickness as compared with the thickness of the remaining side wall for coking chamber 11 which, for the purpose of disclosing the present invention, is assumed to be a first coking chamber in a battery of coke ovens. The ignition chambers 30 and 31 are each provided with a filling of checkerbrick 32. Rider arches 33 span the distance between the side walls 13 and 14. Two parallel channels 35 and 36 interconnect the flues 24 and the ignition chamber 30. The partially-burned distillation products pass through these channels in a generally horizontal direction and enter at the bottom of the ignition chamber 30 to pass in an upward direction through the open spaces in the checkerbrick. Thus, ignition chamber 30 may be referred to as an up-pass chamber and ignition chamber 31 referred to as a down-pass chamber.

Under preferred operating conditions, the checkerbrick 32 will store sufficient heat to maintain an operating temperature of 2250° F in the ignition chambers. As described hereinbefore, it is not possible to maintain such an operating temperature continuously in the ignition chambers because of the varying conditions which affect the supply as well as the temperature of the distillation gases passing into the ignition chambers. It is the primary object of the present invention to insure the smokeless operation of the coke ovens whereby the emissions from the stack are essentially only waves of heat. To achieve this, the temperature in the ignition chambers should not fall below 1400° F to insure incineration of the partially-burned distillation products.

In the ignition chambers, the arched roof 37 forms gas flow spaces 38 above the checkerbrick. Such a roof is preferably of the type known as a "bung" roof which essentially consists of refractory brick fitted into a cast iron frame so that the roof can be removed for cleaning and replacing of the checkerbricks. A wall 39 separates the two ignition chambers. The gases pass over the upper edge of this wall from chamber 30 to chamber 31. It is essential that the partially-burned distillation products which enter into the ignition chambers are completely burned therein, i.e., incinerated, so that products of combustion are drawn off from the bottom of the down-pass ignition chamber 31 through a conduit 40 having a refractory lining and extending along the back of the battery of coke ovens. The gases conducted by conduit 40 are delivered to a stack 41 at the base thereof. A fan 42 is used to control the flow of gases within the stack by supplying additional quantities of air in the stack and thereby control draft on the coking chambers. This control of the draft also controls the flow of gases in the downcomers, sole heating flues and ignition chambers.

An end face wall 43 encloses the outer end of ignition chamber 30. End wall 43 has two openings communicating with the gas flow space between the checkerbricks in the ignition chambers. One of these openings receives the end of a vertically-extending pipe 44 which has a flow control valve 44A to adjust the amount of secondary air which is introduced by pipe 44 into the ignition chamber 30. The admixing of secondary air with the partially-burned distillation gases is controlled by valve 44A to assure incineration of the gases within the ignition chambers. The second opening in wall 43 communicates with a vertically-extending fuel supply pipe 45. A burner 45A is provided on the inner face of wall 43 which receives a controlled supply of fuel, e.g., oil or natural gas. For this purpose, a controller 46 operates in response to a signal from a thermocouple 47 projecting from the lower surface of roof 37 in a manner to detect the temperature within ignition chamber 30. The controller 46 through the use of the signal from thermocouple 47 delivers fuel through pipe 45 to the burner when the temperature in the ignition chamber drops below a predetermined minimum temperature, such as 1400° F, or some other predetermined minimum temperature required to incinerate any unburned distillation gases reaching the ignition chambers. Reference numeral 48 identifies clean-out ports for solid reside that accumulates at the bottom of downcomers 13A and 14A.

As previously described, secondary air is conducted by pipes 15C and pipe 44 for admixing with the partially-burned distillation gases. Each pipe 15C includes a valve 15D to control the flow of air within an associated pipe 15C. A supply of secondary air is provided by a blower 50 which is driven by a motor 51 that is energized by a switch 52. The switch 52 may be operated manually or in response to the output signal from a thermocouple 53 (FIG. 2) in the base of the stack 42. It is preferred, however, to employ the blower 50 to feed air into a refractory recuperator 55 which is well known per se in the art and arranged within the conduit 40. As illustrated in FIG. 2, the recuperator 55 is located between the last coking chamber and the stack. The recuperator is employed to heat the air fed into it from an air supply such as provided by blower 50. By employing the recuperator, the temperature of the gases fed into the stack can be reduced by several hundred degrees and, at the same time, the sensible heat recovered by the recuperator is usefully employed as a heated secondary supply of air which is fed by pipes 15C and 44 into the downcomers and ignition chambers, respectively.

In operation, the coking chambers 11 and 12 are charged with coal as soon as practical after the drawing of coke therefrom so that the stored-up heat from the previous coking process will start the next coking process. With a coking chamber in readiness for charging, the cover 17 is removed from the opening 16 and the charge of coal is dropped through the opening leaving the coal in one or more cone-shaped piles underlying the charging openings. In order to secure uniform coking of the coal, the coal charges are leveled so that the coal takes the form of a bed of uniform thickness above the floor. Typically, the thickness of a coal charge is about 36 inches. After the leveling operation is completed, the door 19A is closed and positioned to form the gap 19C for the supply of primary air into the coking chamber. At the completion of the coking operation, both doors 19A and 19B are removed and the coke is pulled out of the oven chamber.

In conventional prior art coke ovens, the coking process begins soon after leveling is completed, since the bricks forming the walls of the coke oven retain enough heat to start the liberation of volatile matter from the coal. As more heat is absorbed by the coal charge, the temperature of the oven soon reaches the ignition point of the volatile gases which, in the presence of the primary air supply, ignite and continue to burn quietly in the crown of the oven or as small candle-like flames at the surface of the coal mass, thus supplying heat to continue the coking process. It will be appreciated, therefore, that in prior art coke ovens, coking proceeds from the top of the coal downwardly. The coking time depends mainly on the depth of the coal charge. As a rule, it can be said that the coking process proceeds from the top of the coal charge downwardly at a rate of about ½ inch per hour. Assuming, therefore, that the depth of the coal within the oven is 3 feet, the entire coking process takes 72 hours.

In accordance with the present invention, however, the hot gases formed by the partially-burned distillation products are passed through the sole heating flue below floor 21 before the gases are withdrawn and passed through the ignition chambers. Thus, in the coke ovens according to the present invention, the coking process proceeds from the bottom of the coal upwardly as well as from the top downwardly, thereby materially increasing the speed of the coking process. To assure the smokeless production of coke, the gas-conducting system for the partially-burned distillation products receive a controlled supply of secondary air to thereby control the combustion of these products as these products pass in the downcomers, through the sole heating flue and into the ignition chambers. The ignition chambers are normally operated at a temperature of approximately 2250° F to insure incineration of all residuals of distillation that are unburned in either the coking chamber or the sole heating flues 24. The double-pass ignition chamber system of the present invention provides an additional residence time to incinerate the gases. The temperature in the ignition chambers is maintained at all times above a predetermined minimum temperature of, for example, 1400° F, by the burner 44A coupled to the fuel supply line 45 as well as by the addition of secondary air for complete incineration of the distillation products.

The features of the present invention further enhance the coking process in regard to the need to quench the coke at the end of the coking process. The coke quenching process is carried out inside the oven chambers by employing a spray pipe 60 that is moved into an oven chamber through the opening provided by removing door 19A. Water is pumped through the pipe 60 to quench the coke. Essentially all the vapor, steam, etc. created during the quenching process in the oven chamber pass through the sole heating flues and the checker ignition system. The vapor, steam, etc. undergo complete combustion because not only are the ignition chambers maintained above a predetermined minimum temperature but also additional quantities of secondary air are admixed with the vapor, steam, etc. to assure the incineration thereof. This eliminates the major environmental problems heretofore encountered in regard to quenching coke. As shown in FIG. 1, a gas scrubber 62 is located within the stack 41 to remove any residual pollutants in the stack gas. The gas scrubber includes a spray pipe 63 and baffle plates 64.

Although the invention has been illustrated and described for use in a so-called "puller" type non-recovery coke oven, it is believed clearly apparent that all the features and advantages of this invention are applicable for use in a so-called "pusher" type non-recovery coke oven. A pusher type coke oven employs removable doors, similar to doors 19A and 19B, to enclose each end of the rectangular oven chamber. The stack 41 will, however, be situated far enough from the ovens so as to avoid obstruction to the operation of the usual pushing, charging or leveling machinery.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A smokeless and non-recovery type coke oven comprising:

means for forming an oven chamber including side walls, an oven roof carried by the side walls, removable door means for the discharge of coke from the oven chamber, and a floor to support a coal charge introduced into the oven chamber through a closable opening in said roof, means defining a sole heating flue for conducting partially-burned distillation products beneath said floor in heat-conducting contact therewith, means for conducting partially-burned distillation products from the space above a coal charge in said oven chamber into said sole heating flue, means defining a discharge flue arranged to receive the partially-burned distillation products from said sole heating flue, ignition chamber means including first and second ignition chambers each having checkerbricks therein to incinerate the partially-burned distillation products received from said discharge flue, means coupled to at least said first ignition chamber to heat the ignition chamber means independently of the heat liberated by incinerating the partially-burned distillation products and only to maintain a predetermined elevated operating temperature within said first and second ignition chambers, means responsive to the temperature within said ignition chamber means to activate said means to heat the ignition chamber means only when the detected temperature therein falls below said predetermined elevated operating temperature, secondary air supply means coupled to said ignition chamber means to insure and facilitate complete incineration of the partially-burned distillation products within the ignition chamber means independently of said means to heat the same, conduit means extending horizontally to conduct combustion products from said second ignition chamber means, and a stack to draw combustion products from said conduit means.

2. The coke oven according to claim 1 wherein said means for conducting includes spaced-apart downcomers extending within the side walls forming said oven chamber, said coke oven further including secondary air supply means coupled to said downcomers for delivering a secondary supply of air to facilitate incineration of the partially-burned distillation products within said ignition chamber means.

3. The coke oven according to claim 1 wherein said means to heat the ignition chamber means includes a fuel pipe external to said ignition chamber means, and a burner for the combustion of fuel supplied by said fuel pipe within said ignition chamber.

4. The coke oven according to claim 3 further comprising a thermocouple for providing a signal in response to the temperature within said ignition chamber means, said means responsive to the temperature within said ignition chamber means including a control valve responsive to the signal from said thermocouple for controlling operation by said burner.

5. The coke oven according to claim 1 further comprising means coupled to said stack for controllably increasing the withdrawal of combustion products from said ignition chamber and thereby the withdrawal of partially-burned distillation products from the space above the coal charge in the oven chamber.

6. The coke oven according to claim 5 further comprising means within said stack for washing the combustion products received in the stack.

7. The coke oven according to claim 1 further comprising recuperator means to recover sensible heat from the combustion products in said conduit means, and wherein said secondary air supply means includes a blower coupled to said recuperator means for producing a supply of heated secondary air.

8. The coke oven according to claim 7 wherein said blower is coupled to feed heated secondary air from said recuperator into said means for conducting to facilitate incineration of the partially-burned distillation products within the ignition chamber means.

9. The coke oven according to claim 8 further comprising valve means for regulating the flow of heated secondary air from said recuperator into said ignition chamber means, and valve means for regulating the flow of heated secondary air from said recuperator into said means for conducting.

* * * * *